US008176849B1

(12) United States Patent
Gold et al.

(10) Patent No.: US 8,176,849 B1
(45) Date of Patent: May 15, 2012

(54) WARHEAD COMPRISED OF ENCAPSULATED GREEN FRAGMENTS OF VARIED SIZE AND SHAPE

(75) Inventors: Vladimir M. Gold, Hillside, NJ (US); William Poulos, Park Ridge, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 33 days.

(21) Appl. No.: 12/730,318

(22) Filed: Mar. 24, 2010

Related U.S. Application Data

(60) Provisional application No. 61/235,722, filed on Aug. 21, 2009.

(51) Int. Cl.
*F42B 12/22* (2006.01)

(52) U.S. Cl. ..... 102/495; 102/491

(58) Field of Classification Search ..... 102/491, 102/493, 494, 495, 496
See application file for complete search history.

(56) References Cited

U.S. PATENT DOCUMENTS 5,049,212 A * 9/1991 Colick ..... 149/3
5,939,664 A * 8/1999 Kapoor ..... 102/506
7,614,348 B2 * 11/2009 Truitt et al. ..... 102/491

* cited by examiner

*Primary Examiner* — James Bergin
(74) *Attorney, Agent, or Firm* — Michael C. Sachs

(57) ABSTRACT

A fragmentation warhead includes a cylindrical body, and an explosive charge disposed within the innermost part of the warhead body. Upon detonation of the explosive charge, the warhead body is ultimately caused to shear and break into fragments with controlled sizes, shapes. Metallurgical composition of the warhead body can be used to influence the size of fragments ultimately generated when the warhead breaks apart through detonation, since the size and positioning of fragments in the warhead body is preselected. Fabrication of explosive fragmentation ammunition with preformed fragment tungsten alloy fragmenting shells of complex shapes and small and medium calibers is provided in this invention. According to an embodiment of this invention, fabrication begins with "green" tungsten alloy fragment pellets of a given, full strength, enwrapped in a green lower strength matrix alloy. The product is said to be green because tungsten is largely used to replace other metals such as lead which may be considered more toxic. Next, in the process is pressing to the approximate shape desired of the bulk of the green fragments and matrix mix. This is ultimately followed up with sintering. According to an embodiment of this invention, the sintering process will ultimately result in full strength preformed fragments of tungsten alloy enwrapped in a low strength matrix of tungsten alloy, sized to a desired shell shape and thickness.

10 Claims, 2 Drawing Sheets

WARHEAD COMPRISED OF ENCAPSULATED GREEN FRAGMENTS OF VARIED SIZE AND SHAPE

CROSS REFERENCE TO RELATED APPLICATION

This application claims benefit under 35USC119 (e) of the filing date Aug. 21, 2009 of previously filed Provisional Application No. 61/235,722, the entire file contents of which are incorporated by reference herein as though fully set forth.

U.S. GOVERNMENT INTEREST

The inventions described herein may be made, used, or licensed by or for the U.S. Government for U.S. Government purposes.

BACKGROUND OF INVENTION

Warhead fragmentation effectiveness is determined by the number, mass, shape, and velocity of the warhead's fragments. By using a controlled fragmentation design, warhead fragmentation can generally be achieved quickly and in a cost effective manner. Exemplary controlled fragmentation techniques are described in U.S. Pat. Nos. 3,491,694; 4,312,274; 4,745,864; 5,131,329; and 5,337,673.

Conventional designs in general use include "cutter" liners that form fragments by generating a complex pattern of high-velocity "penetrators" for fragmenting the shell. Although these conventional fragmentation designs have proven to be useful, it would be desirable to present additional functional, cost and safety improvements that minimize the warhead weight, reduce manufacture expenses, and advance current United States green and insensitive munition requirements.

What is therefore needed is a convenient, less expensive, fragmentation technique to selectively generate multiple fragment size, fragment numbers, and patterns.

SUMMARY OF INVENTION

The present invention satisfies these needs, and presents a munition or warhead such as part of a projectile made with novel metallurgical configurations which can be used for generating diverse fragmentation patterns. Larger size fragments are selected for more heavily armored targets, while smaller size fragments can be used for lightly armored or soft targets. According to the present invention, warhead fragmentation is achieved more efficiently and more cost effectively than conventional techniques, through the use of a warhead comprised of tungsten alloy fragments of various sizes and shapes; the fragments are joined into a single piece which is also shaped into a desired warhead form. The alloy includes metals such as copper and nickel alloyed to the tungsten. Fabrication of explosive fragmentation ammunition with preformed fragment tungsten alloy fragmenting shells of complex shapes and small and medium calibers is provided in this invention. According to an embodiment of this invention, fabrication begins with "green" tungsten alloy fragment pellets of typically grain to 2 grain size, typically spherical or cubic in shape, then enwrapped in a tungsten alloy of a lower (ksi) strength (made more amenable to be physically pressed/mashed in shape, such as by adding oils to the tungsten alloy mixture used for encapsulating the pellets). The product is said to be green because tungsten is largely used to replace other metals such as lead which may be considered more toxic. Next in the process, is pressing to the approximate shape desired of the bulk of the encapsulated green fragments and formed in a matrix. This is ultimately followed up with sintering to harden it to a final form. According to an embodiment of this invention, the sintering process will ultimately result in full strength preformed fragments of tungsten alloy enwrapped in a low strength matrix of tungsten alloy, sized to a desired shell shape and thickness. During explosion of the warhead, detonation shock waves propagated at the enclosed fragment locations generate contours of localized transitional regions with high-gradients of pressures, velocities, strains, and strain-rates acting as stress and strain concentration factors. As a result, the explosion produces a complex pattern of shear planes in the warhead body, causing shell break-up and release of fragments with predetermined sizes. This invention is therefore distinguishable from existing fragmentation liner technologies that attempt to score or cut the warhead body.

One of the advantages of the present embodiment compared to existing technologies is the cost effectiveness of the manufacturing process of the present design, in that it is faster and more economical to fabricate, as opposed to notching or cutting a steel warhead body itself. The more green tungsten material chosen is less toxic and thus more consistent with current green goals and requirements for minimizing toxicity.

OBJECTS OF THE INVENTION

It is therefore an object of the present invention to provide means for generating fragments upon detonation of a warhead, with a relatively less expensive to manufacture structure of enclosed tungsten alloy fragments, and;

It is a further object of the present invention to provide a fragmentation warhead which generates fragments upon detonation wherein the size and shape of such fragments may be selected through metallurgical design of the warhead material, and;

It is a yet another object of the present invention to provide a fragmentation warhead of materials additionally chosen for green value, i.e., less toxicity.

These and other objects, features and advantages of the invention will become more apparent in view of the within detailed descriptions of the invention and in light of the following drawings, in which:

DETAILED DESCRIPTION

Figure 1:
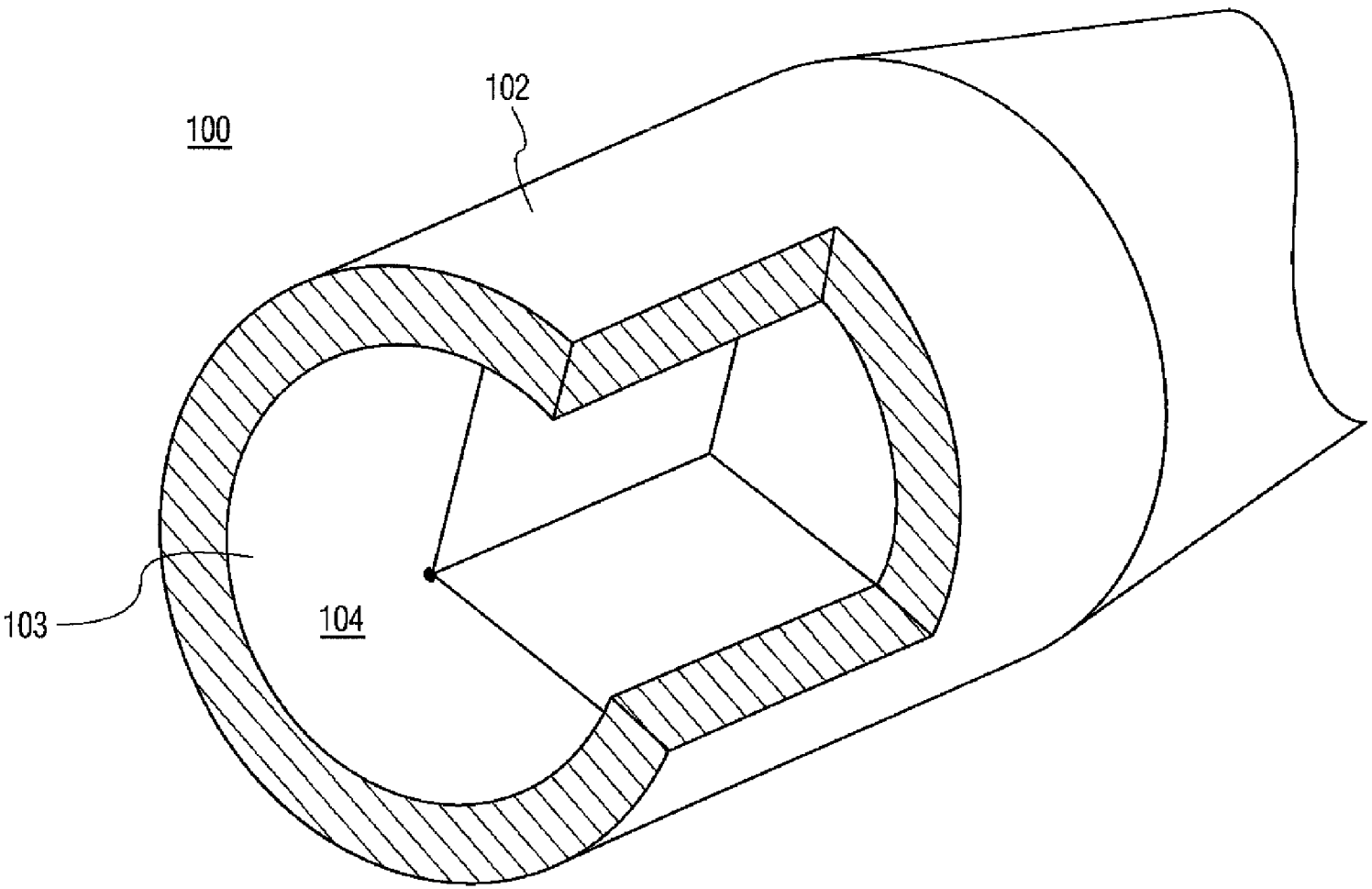
FIG. 1 shows a cutaway isometric view of a fragmenting warhead assembly according to this invention.

FIG. 1 illustrates an exemplary warhead, projectile, shell, munition, explosively formed projectile, or shaped charge liner, etc., (referenced herein as warhead 100), utilizing controlled fragmentation of a warhead body 102 according to the present invention. Warhead 100 generally comprises body 102, an explosive or explosive charge, back plates (not shown), and an initiation mechanism assembly (not shown). The warhead generally takes a cylindrical shape FIG. 1 shows, through open end 103 of the warhead 100, is at the core an explosive 104 surrounded by the generally cylindrically shaped body 102. It should be appreciated that the respective sizes of the warhead housing, thicknesses, lengths, and/or diameters are not precisely to scale in these drawings.

The explosive charge 104 comprises, for example, LX-14, OCTOL, hand packed C-4, or any other solid explosive, that can be machined, cast, or hand-packed to fit snugly within the inside of body 102.

Figure 2:
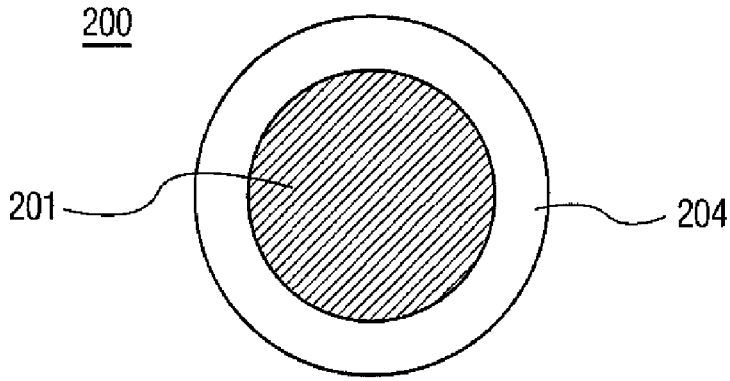
FIG. 2 shows arrangement of an encapsulated fragment in the fragmenting warhead of FIG. 1.
Figure 3:
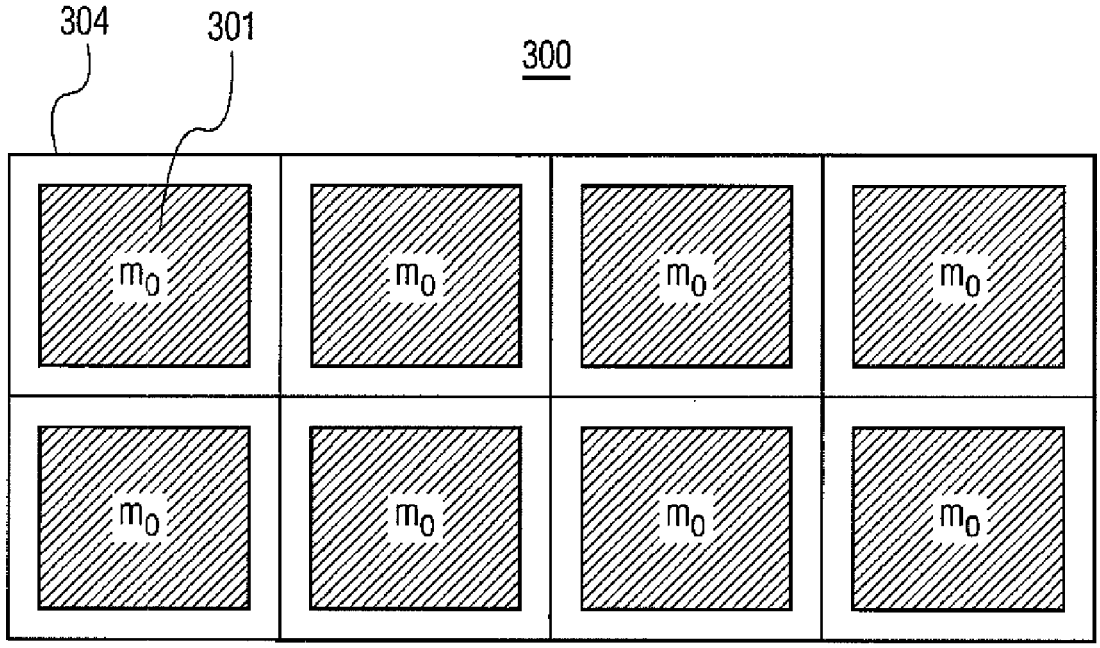
FIG. 3 shows a matrix arrangement of encapsulated fragments formed for the fragmenting warhead of FIG. 1.

The body 102 encloses a multiplicity of encapsulated tungsten alloy fragments (301 in FIG. 3) of select sizes and shapes, and green is used in the sense of using less toxic tungsten as material rather than for instance a more toxic lead material. A selectively controlled pattern of fragments can comprise sections of equal size or, alternatively, sections ranging in size from relatively large to smaller fragments. The larger size of the fragments is selected for more heavily armored targets, while the smaller size of fragments is applicable for lightly armored or soft targets. Consequently, the pattern efficiently enables variable target lethality of the warhead 100 that can range from maximum lethality for more heavily armored targets to a maximum lethality for lightly armored or soft targets. Shapes of individual fragments can be widely varied (spheres, ellipsoids, cylinders, pyramids, cubes, parallelepipeds, curved external shapes, shards, diamond shaped, or truncated versions of any of the above, for instance). Size of individual fragments and orientation of the fragments (turned such as 90 degrees from one another, e.g.) can all be individually selected to advantage in designing the ultimate warhead fragments. FIG. 2 shows how a particle 201 could be encapsulated in a shell 204. FIG. 3 shows how a large quantity of particles 301 might be arranged in a pattern, all encapsulated in a matrix 304, to form a warhead body 300. Here, green tungsten-alloy pellets 301 are individually encapsulated in a green matrix tungsten-alloy shell (such as 204), are arranged, then pressed together into a desired shape matrix 304. Then the assembled matrix 304 is sintered.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A warhead constructed to minimize inclusion of toxic materials, comprising a cylindrical body with preselected fragmentation patterns;

said warhead further comprising a cylindrical explosive charge that is disposed within an interior surface of and completely fills the space of said cylindrical body;

wherein the cylindrical body comprises tungsten-nickel-copper alloy fragments of at least two different sizes which fragments further are encapsulated with a second alloy material containing tungsten, said second alloy material of a lower ksi strength than said fragments, to which said second alloy material and oils are added, said encapsulated fragments being pressed and sintered into preselected desired patterns to form said cylindrical body; and wherein upon detonation of the explosive charge, detonation energy propagating directly to the interior of the body causes the warhead body to shear and break into fragments with controlled sizes and fragmentation patterns.

2. The warhead of claim 1, wherein larger fragment sizes predominate amongst the said two different size fragments, which larger fragment sizes are used to defeat heavily armored targets.

3. The warhead of claim 2, wherein the predominating larger fragments are approximately 2 grains in size.

4. The warhead of claim 1, wherein smaller fragment sizes predominate amongst the said two different size fragments, which smaller fragment sizes are used to defeat light vehicle targets.

5. The warhead of claim 4, wherein the predominating larger fragments are approximately 1 grain in size.

6. The warhead of claim 1, wherein the fragments are ellipsoid in shape.

7. The warhead of claim 1, wherein the fragments are cubic in shape.

8. The warhead of claim 1, wherein the fragments are made from shards.

9. The warhead of claim 1, wherein the warhead further includes back plates and an explosion initiation mechanism.

10. The warhead of claim 1, wherein the warhead includes any one of an exploding body warhead, an explosively formed projectile, and a shaped charge liner.

* * * * *